US005375838A

United States Patent [19]

Labriola et al.

[11] Patent Number: 5,375,838

[45] Date of Patent: Dec. 27, 1994

[54] GOLF TEE

[76] Inventors: Louis A. Labriola, 2521 Woodside Dr., Fort Lauderdale, Fla. 33312; Thomas A. Labriola, 414 Pine Pl., Uniondale, N.Y. 11553

[21] Appl. No.: 192,382

[22] Filed: Feb. 7, 1994

[51] Int. Cl.[5] ..... A63B 57/00

[52] U.S. Cl. ..... 273/33; 273/203; 273/204

[58] Field of Search ..... 273/33, 202-208

[56] References Cited

U.S. PATENT DOCUMENTS

| | | | |
|---|---|---|---|
| 1,807,377 | 5/1931 | Brokaw | 273/207 |
| 1,839,040 | 12/1931 | McCarrier | 273/202 |
| 1,942,672 | 1/1934 | Thompson | 273/202 |
| 2,456,511 | 12/1948 | Isserstedt | 273/205 |
| 2,839,304 | 6/1958 | Lerick . | |
| 3,292,929 | 12/1966 | Russell | 273/203 |
| 3,424,457 | 1/1969 | Robertson . | |
| 3,575,420 | 4/1971 | Turner et al. . | |
| 3,743,298 | 7/1973 | Reynolds | 273/204 |
| 4,645,208 | 2/1987 | Morabeto . | |

*Primary Examiner*—V. Millin
*Assistant Examiner*—Raleigh W. Chiu
*Attorney, Agent, or Firm*—Alvin Blum

[57] ABSTRACT

A golf tee provides a preset elevation of the ball above the playing surface. The tee body is mounted at the end of a horizontal arm. The horizontal arm is fixed to a vertical arm with a barbed end. When the tee body is struck, it will pivot about the vertical arm and bend forward, but resist pulling out of the ground. The tee body may also be pivotably mounted on the horizontal arm, so that it also pivots about the horizontal arm to further dissipate forces. The tee body may be adapted to be replacable on the horizontal arm for replacement with a tee body having a different elevation.

18 Claims, 1 Drawing Sheet

GOLF TEE

BACKGROUND OF THE INVENTION

This invention relates to golf tees and more particularly to a reusable, pivotable golf tee providing reproducible ball elevation.

Golf tees are used to elevate the ball above the playing surface. Conventional golf tees are one piece painted wood or plastic. When a club swing is not perfect, the tee is either broken or flies so far it is lost. An estimated 1.5 billion wooden tees were sold in the United States in 1992.

They remain on the golf courses to pollute the environment, and the consumption of materials for their manufacture is a needless waste of resources. A golf tee which is able to withstand the trauma of play would overcome this pollution and waste of resources. A tee which can pivot when struck is better able to withstand trauma and remain in place. When properly designed, it can also improve the flight of the ball. Some of the art and advantages of pivotable golf tees are reviewed in U.S. Pat. No. 3,575,420 issued Apr. 20, 1971 to Turner and U.S. Pat. No. 4,645,208 issued Feb. 24, 1987 to Morabeto.

Although many pivotable golf tee patents have been issued, some problems remain with their design and function. Some are expensive to manufacture. For optimum retention when struck, they must be inserted deep into the ground. How deep they are inserted may vary, depending upon the soil type and user's skill. However, it is desirable to always maintain the ball on the tee at a reproducible elevation above the playing surface for best results.

SUMMARY OF THE INVENTION

It is, accordingly, an object of the invention to provide a pivotable golf tee which is better retained in the ground and better able to withstand trauma so that it may be used repeatedly and not lost, to benefit both the golfer and the environment. It is another object to provide such a tee which provides a readily reproducible elevation of the ball above the playing surface. It is yet another object that the tee minimally impair the flight of the ball.

The golf tee of the invention comprises a rigid body with a broad top carrying a surface indentation to receive the ball in the usual manner. The body tapers to a small bottom arranged for resting on the playing surface. A transverse cylindrical passage passes horizontally through the body at a point intermediate the top and bottom. A tee support member has a horizontal arm which is received by the passage to pivotally support the body. A vertical arm of the member joins the horizontal arm at one end thereof for insertion into the playing surface. At the lower end of the vertical arm, a barb element is provided. The barb end is arranged for easy insertion and resistive removal from the playing surface. The barb extends in the same plane as the horizontal arm. When the tee is struck, the body may pivot about the horizontal arm. The tee may be easily lifted out because the barb will pass through the path it has already cut in the surface. If the tee is struck harder and below the horizontal arm, the body will also pivot about the vertical arm and tilt the vertical arm forward. The barb will then encounter a virgin path and therefore resist pulling out and flying away. Alternatively, the body is fixed on the horizontal arm so it pivots only about the vertical arm.

These and other advantages, features and objects of the invention will become more apparent when the detailed description is studied in conjunction with the drawings, in which:

DETAILED DESCRIPTION OF PREFERRED EMBODIMENTS OF THE INVENTION

Figures 1, 2, 3, 4, 5, 6:
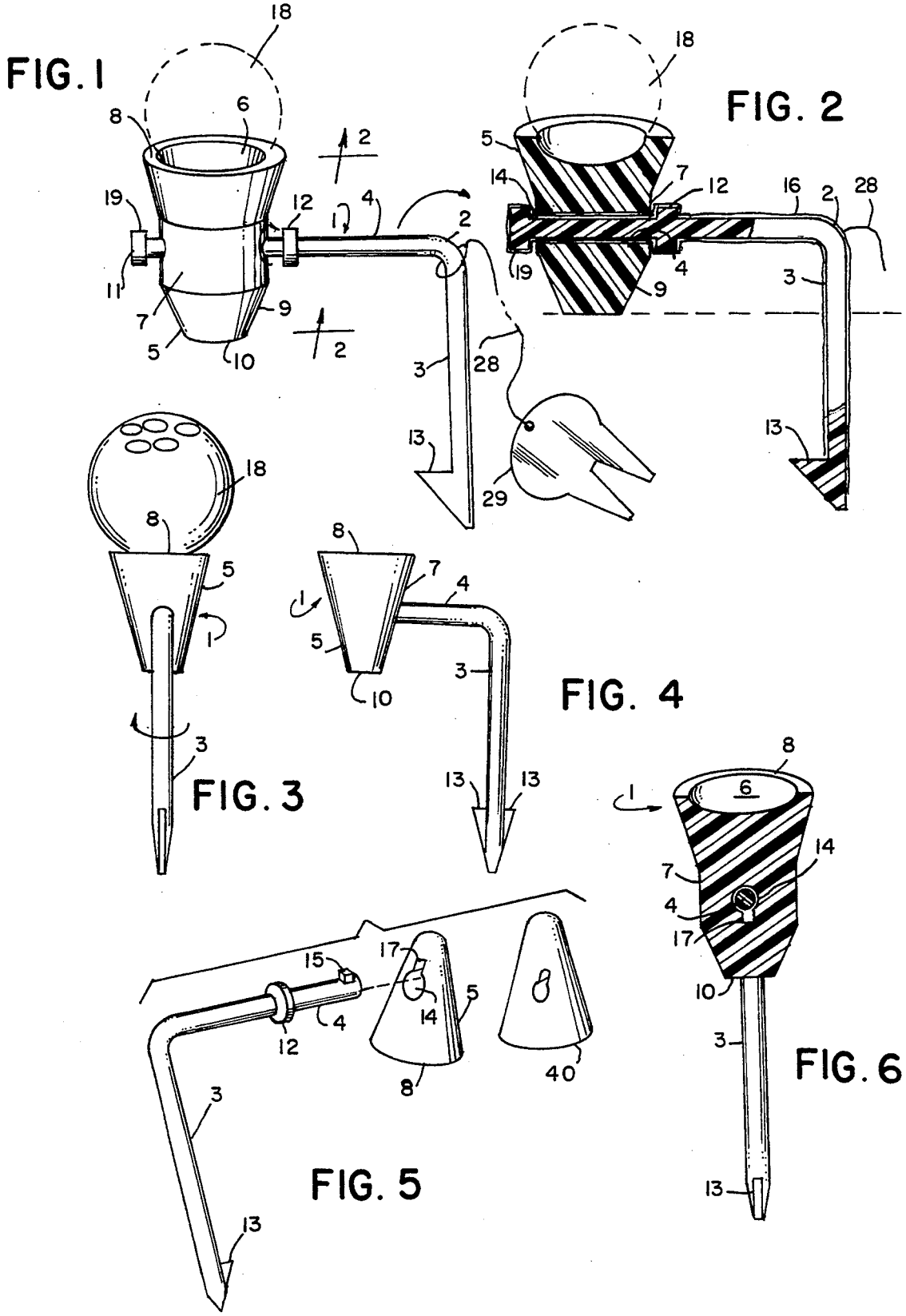
FIG. 1 is a perspective view of a tee of the invention.
FIG. 2 is a sectional view taken through line 2—2 of FIG. 1.
FIG. 3 is a side elevation view of another embodiment of the invention.
FIG. 4 is a front elevation view of the tee of FIG. 3.
FIG. 5 is an exploded perspective view of another embodiment of the invention.
FIG. 6 is a sectional view of another embodiment of the invention.

Referring now first to FIGS. 1 and 2, a support member 2 comprises a vertical arm 3 with a sharp end having at least one barb 13 for pushing into the playing surface. A horizontal support arm 4 is fixed to the top of the vertical arm. Mounted at the distal end 11 of arm 4 is a tee body 5. A depression 6 in upper horizontal surface 8 is arranged conventionally for holding a golf ball 18. A horizontal passage 14 through the intermediate portion 7 of the body 5 receives the support arm 4 such that the body is pivotable about the arm. The body tapers to a smaller lower portion 9 arranged for resting on the playing surface. The reduced area of the bottom portion 9 reduces playing surface resistance to pivoting. A first stop 12 keeps the body at the far end of the arm. A second stop 19 prevents the body from slipping off the distal end 11 of the arm. Optionally, a line 28 may be tied around the support 2 with a tool 29 at the free end. This may provide a tether to reduce flight of the tee, makes finding it easier either in the grass or in a pocket. Optionally, a rubbery coating 16 may be applied to the tee to hold the body on the arm, to protect the club and tee from direct contact, to maintain an upright position of the body relative to its support, and to keep the joint free of debris.

The tee operates in the following manner:

When the barbed point is pushed vertically into the playing surface 30, it will stop when bottom 10 of the tee body engages the playing surface. This puts the elevation of the ball at a preset elevation, for more consistent playing conditions. When the tee is inadvertently struck or forced forward by a club swing, the body 5 will pivot about the horizontal arm 4 and the horizontal arm will pivot about the vertical arm 3. The vertical arm 3 may also be tilted forward. Because the barb 13 will now be rotated to an uncut area, it will resist being pulled out. Also, the energy of the blow will be further dissipated by rotation about the two axes. Furthermore, because the body rotates away from the ball, there is less interference by the tee body on the flight of the ball to further enhance play.

FIGS. 3 and 4 show a tee 1 of the invention in which the tee body is rigidly fixed to the horizontal arm 4 at the intermediate portion. By mounting the tee body 5 at a considerable distance from vertical arm 3, there is a greater tendency for the body to pivot about arm 3 rather than pull out of the ground.

FIG. 5 shows another embodiment of the invention, in which the tee body 5 is pivotably mounted on the horizontal arm 4 in such fashion that it may be readily removed and replaced with another tee body having a different elevation so that a player may have a choice of elevations to suit various playing situations. The means of removably locking the body 5 on arm 4 may include a key 15 on the distal end of arm 4 and a corresponding keyway 17 in horizontal passage 14 in the tee body 5. The key and keyway are arranged so that the body will slip onto the arm when the body is inverted, but will not slip off when the body is upright. If the passage 14 is below the midline of the body, there will be even less tendency for the body to rotate 180 degrees in play.

FIG. 6 shows a tee 1 provided with detent means to maintain the body in an upright position yet permit it to pivot when struck. The passage 14 is provided with a slightly out of round or oval shape. The horizontal arm 4 that fits into the passage is also provided with a similar cross section, but slightly smaller for free sliding laterally, but a slight resistance to rotation from the vertical position. This device also employs the key and keyway mechanism of FIG. 5.

The above disclosed invention has a number of particular features which should preforably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A golf tee comprising:

A) a support member having an elongate vertical arm and two ends;

B) at least one ground-engaging barb means for ground engaging more tenaciously in upward than downward direction at a first end;

C) an elongate horizontal support arm extending substantially orthogonally from said vertical arm at a second end of said vertical arm, said horizontal support arm being attached to said vertical arm at a permanently fixed angle;

D) a tee body having a ball-receiving depression on its upper, horizontal surface, an intermediate portion, and a lower portion, said lower portion terminating in a bottom adapted for resting upon a playing surface when said first end is inserted into said inlaying surface to thereby support a ball in said depression at a reproducible elevation above said playing surface;

E) mounting means for mounting said intermediate portion of said tee body upon said horizontal support arm at the distal end of said horizontal support arm;

F) said tee body thereby arranged to pivot about said vertical arm when struck.

2. The tee according to claim 1, in which said tee body is fixedly mounted upon said support arm.

3. The tee according to claim 1, in which said tee body is pivotably mounted upon said support arm at said intermediate portion, said mounting means enabling said tee body to rotate about said support arm when struck.

4. The tee according to claim 3, further comprising a rubbery coating enclosing at least said tee body and said support arm.

5. The tee according to claim 3, in which said mounting means provides means for removably mounting said tee body upon said support arm.

6. The tee according to claim 5, further comprising at least one additional tee body providing a different elevation of said depression above said playing surface to enable a player to select an elevation more suited to a particular playing situation.

7. The tee according to claim 6, wherein the mounting means further comprises at least one key means at said distal end of said support arm, said key means for cooperating with a keyway for permitting sliding of said body upon said support arm in a first rotary position and for preventing sliding in other rotary positions of said body, and a horizontal passage through said intermediate portion of said tee body to rotatably receive said support arm, said passage provided with a keyway corresponding to said key means so arranged as to permit said tee body to slide upon said support arm when said tee body is in a first rotary position and to prevent said tee body from sliding off said support arm when said tee body is in a second rotary position, said second rotary position being that in which said depression is uppermost.

8. The tee according to claim 7, further comprising detent means for releasably maintaining said second rotary position.

9. The tee according to claim 5, wherein the mounting means further comprises at least one key means at said distal end of said support arm, said key means for cooperating with a keyway for permitting sliding of said body upon said support arm in a first rotary position and for preventing sliding in other rotary positions of said body, and a horizontal passage through said intermediate portion of said tee body to rotatably receive said support arm, said passage provided with a keyway corresponding to said key means so arranged as to permit said tee body to slide upon said support arm when said tee body is in a first rotary position and to prevent said tee body from sliding off said support arm when said tee body is in a second rotary position, said second rotary position being that in which said depression is uppermost.

10. The tee according to claim 9, in which said mounting means further comprises detent means for releasably maintaining said second rotary position.

11. The tee according to claim 3, in which said tee body is permanently pivotably mounted upon said support arm.

12. The tee according to claim 9, further comprising detent means for releasably maintaining said tee body upon said support arm in a position with said depression uppermost.

13. The tee according to claim 3, in which said bottom of said tee body has a reduced area relative to the horizontal cross section area at said intermediate portion for reduced playing surface resistance to pivoting.

14. A golf tee comprising:

A) a support member having an elongate vertical arm and two ends:

B) at least one ground-engaging barb means for ground engaging more tenaciously in upward than downward direction at a first end;

C) an elongate horizontal support arm extending substantially orthogonally from said vertical arm at a second end of said vertical arm;

D) a tee body having a ball-receiving depression on its upper, horizontal surface, an intermediate portion, and a lower portion, said lower portion terminating in a bottom adapted for resting upon a playing surface when said first end is inserted into said playing surface to thereby support a ball in said depression at a reproducible elevation above said playing surface;

E) mounting means for mounting said intermediate portion of said tee body upon said horizontal support arm at the distal end of said horizontal support arm;

F) said tee body thereby arranged to pivot about said vertical arm when struck;

G) said mounting means further providing means for removably mounting said tee body upon said support arm; and H) at least one additional tee body providing a different elevation of said depression above said playing surface to enable a player to select an elevation more suited to a particular playing situation.

15. The tee according to claim 14, wherein the mounting means further comprises at least one key means at said distal end of said support arm, said key means for cooperating with a keyway for permitting sliding of said body upon said support arm in a first rotary position and for preventing sliding in other rotary positions of said body, and a horizontal passage through said intermediate portion of said tee body to rotatably receive said support arm, said passage provided with a keyway corresponding to said key means so arranged as to permit said tee body to slide upon said support arm when said tee body is in a first rotary position and to prevent said tee body from sliding off said support arm when said tee body is in a second rotary position, said second rotary position being that in which said depression is uppermost.

16. The tee according to claim 15, further comprising detent means for releasably maintaining said second rotary position.

17. A golf tee comprising:

A) a support member having an elongate vertical arm and two ends;

B) at least one ground-engaging barb means for ground engaging more tenaciously in upward than downward direction at a first end;

C) an elongate horizontal support arm extending substantially orthogonally from said vertical arm at a second end of said vertical arm;

D) a tee body having a ball-receiving depression on its upper, horizontal surface, an intermediate portion, and a lower portion, said lower portion terminating in a bottom adapted for resting upon a playing surface when said first end is inserted into said playing surface to thereby support a ball in said depression at a reproducible elevation above said playing surface;

E) mounting means for mounting said intermediate portion of said tee body upon said horizontal support arm at the distal end of said horizontal support arm;

F) said tee body thereby arranged to pivot about said vertical arm when struck;

G) said mounting means further providing means for removably mounting said tee body upon said support arm; and H) at least one key means at said distal end of said support arm, said key means for cooperating with a keyway for permitting sliding of said body upon said support arm in a first rotary position and for preventing sliding in other rotary positions of said body, and a horizontal passage through said intermediate portion of said tee body to rotatably receive said support arm, said passage provided with a keyway corresponding to said key means so arranged as to permit said tee body to slide upon said support arm when said tee body is in a first rotary position and to prevent said tee body from sliding off said support arm when said tee body is in a second rotary position, said second rotary position being that in which said depression is uppermost.

18. The tee according to claim 17, further comprising detent means for releasably maintaining said second rotary position.

* * * * *